US010874895B2

(12) United States Patent
Isom

(10) Patent No.: US 10,874,895 B2
(45) Date of Patent: Dec. 29, 2020

(54) WORKOUT BENCH AND HANDLES WITH ADJUSTABLE BANDS THEREBETWEEN AND METHODS OF USE THEREOF

(71) Applicant: Walter Isom, Atlanta, GA (US)

(72) Inventor: Walter Isom, Atlanta, GA (US)

( * ) Notice: Subject to any disclaimer, the term of this patent is extended or adjusted under 35 U.S.C. 154(b) by 20 days.

(21) Appl. No.: 16/190,553

(22) Filed: Nov. 14, 2018

(65) Prior Publication Data

US 2019/0151699 A1 May 23, 2019

Related U.S. Application Data

(60) Provisional application No. 62/586,236, filed on Nov. 15, 2017.

(51) Int. Cl.

| | |
|---|---|
| ***A63B 1/04*** | (2006.01) |
| ***A63B 21/00*** | (2006.01) |
| ***A63B 21/055*** | (2006.01) |
| ***A63B 23/035*** | (2006.01) |
| ***A63B 21/04*** | (2006.01) |

(52) U.S. Cl.

CPC .... *A63B 21/0442* (2013.01); *A63B 21/00047* (2013.01); *A63B 21/00061* (2013.01); *A63B 21/00065* (2013.01); *A63B 21/00069* (2013.01); *A63B 21/0557* (2013.01); *A63B 21/4029* (2015.10); *A63B 23/03541* (2013.01); *A63B 2225/093* (2013.01)

(58) Field of Classification Search

CPC ..... A63B 21/0442; A63B 21/00065; A63B 21/0557; A63B 23/03541; A63B 21/00061; A63B 21/00047; A63B 21/4029; A63B 21/00069; A63B 2225/093; A63B 21/02; A63B 21/028; A63B 21/00189; A63B 21/00043

See application file for complete search history.

(56) References Cited

U.S. PATENT DOCUMENTS

| | | | | |
|---|---|---|---|---|
| 3,427,023 A * | 2/1969 | Silberman | ..... | A63B 21/4043 482/139 |
| 6,245,001 B1 * | 6/2001 | Siaperas | ..... | A63B 21/04 482/123 |
| 6,398,698 B1 * | 6/2002 | Hinds | ..... | A63B 21/0004 482/124 |

(Continued)

*Primary Examiner* — Andrew S Lo

(74) *Attorney, Agent, or Firm* — Mathew L. Grell; Jeffrey C. Watson; Grell & Watson Patent Attorneys LLC

(57) ABSTRACT

A workout bench having a bench and a support frame having at least one vertical support member and at least one horizontal member having a first foot member end and a second foot member end, one or more band mounts configured to affix thereto the support frame, the one or more frame band mounts having one or more band adjustment slots, the one or more frame band mounts includes at least one vertical frame band mount configured to affix thereto the at least one vertical support member, and at least two horizontal frame band mounts, a first horizontal frame band mount configured to affix thereto the first foot member end and a second horizontal frame band mount configured to affix thereto the second foot member end, one or more resistance bands with spaced raised stops configured to adjustably catch therein the one or more band adjustment slots, and a handle.

19 Claims, 7 Drawing Sheets

(56) References Cited

U.S. PATENT DOCUMENTS 6,805,409 B2 * 10/2004 Parker ..... A47C 9/002 297/158.4
7,217,228 B2 * 5/2007 Marquez ..... A63B 21/055 482/122
7,294,097 B2 * 11/2007 Parker ..... A63B 21/4029 482/142
7,431,681 B1 * 10/2008 St. Cyr ..... A63B 21/0552 482/121
7,601,101 B2 * 10/2009 Jackson ..... A63B 21/04 482/142
7,736,286 B2 * 6/2010 Panaiotov ..... A63B 21/16 482/121
7,780,586 B2 * 8/2010 Gates ..... A63B 21/078 482/142
8,475,345 B2 * 7/2013 Wang ..... A63B 21/00043 403/348
9,314,658 B2 * 4/2016 Kaye ..... A63B 21/0557
9,901,502 B2 * 2/2018 Rosario, Jr. ..... A61G 13/009
10,232,213 B1 * 3/2019 Smith, Jr. ..... A63B 1/00
10,307,632 B1 * 6/2019 Santana ..... A63B 23/1209
2005/0075223 A1 * 4/2005 Wu ..... A63B 21/0004 482/126
2005/0187080 A1 * 8/2005 Bowser ..... A63B 21/1609 482/121
2005/0233875 A1 * 10/2005 Clarke ..... A63B 21/1609 482/123
2007/0042881 A1 * 2/2007 Wu ..... A63B 21/0004 482/126
2007/0270292 A1 * 11/2007 Laney ..... A63B 21/4035 482/121
2008/0076641 A1 * 3/2008 Sheehan ..... A63B 21/078 482/92
2009/0069161 A1 * 3/2009 Caldwell ..... A63B 23/12 482/138
2009/0215594 A1 * 8/2009 Panaiotov ..... A63B 21/0552 482/130
2011/0053738 A1 * 3/2011 Osbourne ..... A63B 23/0355 482/122
2011/0065554 A1 * 3/2011 Van Straaten ..... A63B 21/0552 482/130
2011/0152046 A1 * 6/2011 Rochford ..... A63B 21/04 482/131
2012/0053026 A1 * 3/2012 Kopp ..... A63B 21/4013 482/124
2012/0202657 A1 * 8/2012 Wang ..... A63B 21/0557 482/122
2013/0025091 A1 * 1/2013 Musachio ..... A63B 23/03541 24/300
2015/0038304 A1 * 2/2015 Davenport ..... A63B 21/0724 482/123
2015/0367165 A1 * 12/2015 Wagner ..... A63B 21/0552 482/121
2016/0089558 A1 * 3/2016 Noyes ..... A63B 21/4029 482/130
2017/0021220 A1 * 1/2017 Pagano ..... A63B 21/0557
2017/0028245 A1 * 2/2017 Williams ..... A63B 21/4035
2017/0036058 A1 * 2/2017 Davenport ..... A63B 21/4029
2017/0100622 A1 * 4/2017 Wall ..... A63B 21/4029
2017/0209735 A1 * 7/2017 McCall, Jr. ..... A63B 21/4029
2018/0236298 A1 * 8/2018 Donnelly ..... A63B 21/4029
2018/0290002 A1 * 10/2018 Colangelo ..... A63B 21/4037
2018/0339181 A1 * 11/2018 Weisz ..... A63B 23/03541
2019/0105527 A1 * 4/2019 Hallmark ..... A63B 23/1227
2019/0126122 A1 * 5/2019 Vester ..... A63B 47/00
2019/0240528 A1 * 8/2019 Donnelly ..... A63B 71/0036
2019/0299042 A1 * 10/2019 Slayton ..... A63B 21/0442

* cited by examiner 300
312
342
310
343
344

PWB BENCH & RESISTANCE BANDS
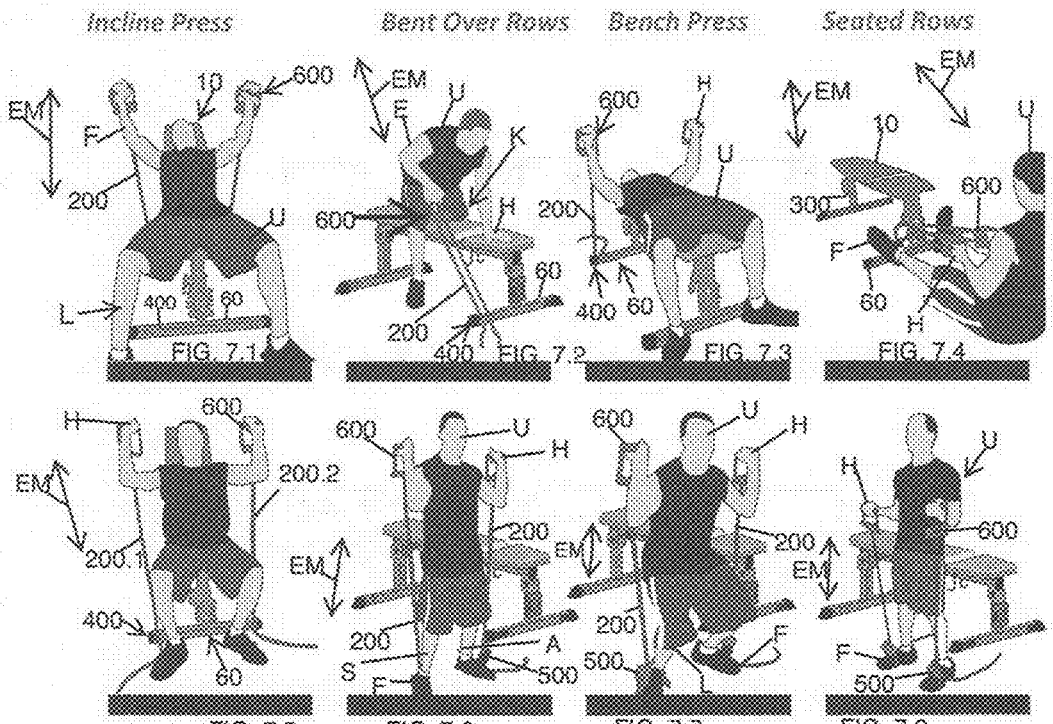

WORKOUT BENCH AND HANDLES WITH ADJUSTABLE BANDS THEREBETWEEN AND METHODS OF USE THEREOF

CROSS-REFERENCE TO RELATED APPLICATIONS

To the full extent permitted by law, the present United States Non-provisional Patent Application hereby claims priority to and the full benefit of, U.S. Provisional Application No. 62/586,236, filed on Nov. 15, 2017, entitled "Workout Bench with Bands and Methods of Use", which is incorporated by reference herein in its entirety.

FIELD OF THE DISCLOSURE

The present disclosure relates to exercise equipment and methods of use thereof. More specifically, the present disclosure is directed to usage of an adjustable band between a workout bench and a handle and a method of use thereof.

BACKGROUND

A variety of different pieces of exercise equipment have been developed over the years to assist with or emphasize the exercise of different parts of the body, groups of muscles, or even isolated muscles. For example, a weight training bench is a piece of equipment that resembles a standard bench, but is designed for use in weight training. Weight training or workout benches may be configured in a variety of designs, such as fixed horizontal or flat bench, fixed in a bent or folded position, with one vertically adjustable section, or with two or more vertically adjustable sections. Moreover, weight training or workout benches may be utilized to lift weights, such as a bar with weights or hand weighs like dumbbells. One disadvantage to this approach of using a weight training or workout bench is that each time you want to change the weight being lifted you have to get up off the bench and retrieve a heavier or lighter weight from a weight rack and return to the bench. This is time consuming and is very prone to injury, especially when lifting heavy weights. A user of the weight training or workout bench who is lifting heavy weights may either raise up off the bench with the weights in hand or attempt to release the weight to the floor to exit the exercise. Either release, places added strain on the muscles, may extend the muscle or tendon beyond its strength range, or over exert the core in an attempt to stabilize the lower back during this movement.

Another approach involving a chair, weight training or workout bench configure as an inclined bench includes a sliding bench or platform where a user utilizes his or her body weight positioned on the bench and a series of pulleys, cables, and handles to perform a variety of load bearing exercises. One disadvantage to this approach of using a weight training or workout bench and a series of pulleys, cables, and handles is that you are limited in the amount of weight lifted since you are lifting your body weight. Another disadvantage is that a user is limited to exercises that may be performed via cable movements associated with raising and lowering their weight on the sliding bench or platform.

Another approach involving a chair, weight training or workout bench configure as an inclined bench includes the use of a sliding bench or platform where a user utilizes his or her body weight positioned on the bench and a series of pulleys, cables, and handles to perform a variety of load bearing exercises. In addition, one or more resistance bands may be removeably affixed between a base end of the sliding bench or platform and the bench frame to add additional resistance against the movement of the sliding bench or platform. One disadvantage to this approach of using a weight training or workout bench and a series of pulleys, cables, handles, and one or more resistance bands removeably affixed to the frame is that a user is limited to exercises that may be performed via cable movements associated with raising and lowering their resisted weight on the sliding bench or platform. Another disadvantage is the need for adjustment of the bench and pulley to the torso length and wingspan of the user wherein lack of adjustment limits the range of motion of smaller or larger user's range of motion.

Another approach involving a chair, weight training or workout bench includes a two section bench with one section being vertically adjustable to configure as an inclined bench and a series of pulleys, resistant cords with one end affixed to the bench frame, and the other end affixed to a handle to perform a variety of resistance bearing exercises. One disadvantage to this approach of using a weight training or workout bench and a series of pulleys, resistance bands, and handles is that you are limited in the amount of resistance by the number of fixed bands. Another disadvantage is that a user is limited to exercises that may be performed via cable movements associated with raising and lowering their weight on the sliding bench or platform.

Therefore, it is readily apparent that there is a need for a workout bench and handles with adjustable bands removeably positioned therebetween and methods of use thereof that functions to enable a combination of features including safety and ease of use each time you want to change the weight or resistance being lifted, time saved not having to get up off the bench or leave the bench area and retrieve a heavier or lighter weight from a weight rack and return to the bench, not being limited in the amount of weight lifted since you are lifting against increased number of resistance bands, not limited to exercises that may be performed via cable movements associated with raising and lowering their weight on the sliding bench or platform, and not limited in the amount of resistance by the number of fixed bands, and thus, providing improve efficiency, amount of resistance, and variety of exercises capable of being performed. The instant disclosure is designed to address at least certain aspects of the problems or needs discussed above by providing a workout bench and handles with adjustable bands removeably positioned therebetween and methods of use thereof.

SUMMARY

Briefly described, in an example embodiment, the present disclosure may overcome the above-mentioned disadvantages and may meet the recognized need for a workout bench and handles with adjustable bands removeably positioned therebetween. The workout bench may include a bench and a support frame having at least one vertical support member and at least one horizontal foot member having a first foot member end and a second foot member end. The workout bench system may include one or more band mounts configured to affix thereto the support frame, the one or more frame band mounts may have one or more band adjustment slots. The one or more frame band mounts may include at least one vertical frame band mount configured to affix thereto the at least one vertical support member, and at least two horizontal frame band mounts, a first horizontal frame band mount configured to affix thereto the first foot member end and a second horizontal frame band mount configured to affix thereto the second foot member end. One or more resistance bands with spaced raised stops may be configured to adjustably catch therein the one or more band adjustment slots, and a handle may be configured to affix to the one or more resistance bands. Thus, to improve safety and ease of use each time you want to change the weight or resistance being lifted, time saved not having to get up off the bench or leave the bench area and retrieve a heavier or lighter weight from a weight rack and return to the bench, not being limited in the amount of weight lifted since you are lifting against increased number of resistance bands, expanded set of exercises providing improve efficiency, amount of resistance, and variety of exercises capable of being performed.

Accordingly, in one aspect, the present disclosure embraces a handle configured with a band mount having one or more band adjustment slots. The handle configured with a band mount having one or more band adjustment slots may be utilized to adjust the length of the resistance band by adjustibly sliding a first end of the resistance band with spaced raised stops therein one of the one or more band adjustment slots. Moreover, a second end of the resistance band with spaced raised stops may be utilized to adjust the length of the resistance band by adjustibly sliding the second end of the resistance band with spaced raised stops therein one of the one or more band adjustment slots of one of the one or more frame band mounts to enable resistance exercise between the handle and the workout bench. These adjustment of the length of the resistance band by adjustibly sliding the resistance band in one of the one or more band adjustment slots enables a user to adjust the length of the resistance band to the height, torso length, extremity length and wingspan of the user.

Accordingly, in one aspect, the present disclosure embraces a foot/leg attachment configured with a band mount having one or more band adjustment slots. The foot/leg attachment may be configured with a band mount having one or more band adjustment slots and may be utilized to adjust the length of the resistance band by adjustibly sliding a second end of the resistance band with spaced raised stops therein one of the one or more band adjustment slots to adjust the length of the resistance band. Moreover, a first end of the resistance band with spaced raised stops may be utilized to adjust the length of the resistance band by adjustibly sliding the second end of the resistance band with spaced raised stops therein one of the foot/leg attachment one or more band adjustment slots of to enable resistance exercise between the foot/leg attachment and the workout bench. Still furthermore, a first end of the resistance band with spaced raised stops may be utilized to adjust the length of the resistance band by adjustibly sliding the first end of the resistance band with spaced raised stops therein one of the one or more band adjustment slots of the handle configured with a band mount having one or more band adjustment to enable resistance exercise between the foot/leg attachment and the handle independent of the workout bench. These adjustment of the length of the resistance band by adjustibly sliding the resistance band in one of the one or more band adjustment slots may enable a user to adjust the length of the resistance band to the height, torso length, extremity length and wingspan of the user.

In an exemplary embodiment of the workout bench and handles-foot/leg attachments with adjustable bands removeably positioned therebetween and methods of use thereof may include a bench, the bench having a platform and a support structure to support the bench, the support structure may have at least one vertical support member configured to elevate the platform, the vertical support member affixed thereto at least one horizontal support member may be configured to provide a stable base. The workout bench system may include one or more band mounts configured to affix to the support structure, each band mount having a plurality of slotted apertures. The workout bench system may include one or more resistance bands having a first band end and second band end, the one or more resistance bands having spaced thereon a plurality of raised stops between the first band end and the second band end to adjustably catch one of the raised stops proximate the first band end therein one of the plurality of slotted apertures. The workout bench system may include at least one limb band device, the at least one limb band device may have a plurality of apertures to receive the second end of the one or more resistance bands.

In another exemplary embodiment of the workout system with handles-foot/leg attachments with adjustable bands removeably positioned therebetween and methods of use thereof may include one or more resistance bands having a first band end and second band end, the one or more resistance bands having spaced thereon a plurality of raised stops between the first band end and the second band end. The workout system with handles-foot/leg attachments may be utilized to adjustably catch one of the raised stops proximate the first band end therein one of the plurality of slotted apertures. The workout system with handles-foot/leg attachments may include two limb band devices, the two limb band devices having a plurality of apertures to receive the first band and the second end of the one or more resistance bands.

A feature of the workout bench and handles-foot/leg attachments with adjustable bands removeably positioned therebetween and methods of use thereof may include its ability to enable adjustment of the length of the resistance band by adjustibly sliding the resistance band in one of the one or more band adjustment slots to enable a user to adjust or configure the length of the resistance band to the height, torso length, extremity length and wingspan of the user.

Another feature of the workout bench and handles-foot/leg attachments with adjustable bands removeably positioned therebetween and methods of use thereof may be the ability to enable a user to easily adjust the resistance of an exercise by add additional resistance bands while remaining local to the bench versus having to relocate each time you want to change the weight and retrieve a heavier or lighter weight from a weight rack.

Another feature of the workout bench and handles-foot/leg attachments with adjustable bands removeably positioned therebetween and methods of use thereof may be the ability to enable a user to perform a variety of exercises, including, but not limited to, incline press, bent over rows, bench press, seated rows, military press, squats, bicep curls, triceps, forearm curls, lower back extension, abs, arm extensions, deltoids and trapezius (shoulders), and the like.

Another feature of the workout bench and handles-foot/leg attachments with adjustable bands removeably positioned therebetween and methods of use thereof may include the ability to enable a user to perform exercises without cable movements associated with raising and lowering their weight on the sliding bench or platform.

Another feature of the workout bench and handles-foot/leg attachments with adjustable bands removeably positioned therebetween and methods of use thereof may include the ability to enable a user to increase the resistance of an exercise by increasing the number of resistance bands or changing resistance bands to ones having more resistance—by decreasing the length of a band or adding additional or multiple bands.

Another feature of the workout bench and handles-foot/leg attachments with adjustable bands removeably positioned therebetween and methods of use thereof may include the ability to provide improve efficiency by enabling a user to perform a variety of exercises with workout bench and handles-foot/leg attachments rather than retrieving a heavier or lighter weight from a weight rack and return to the bench.

Another feature of the workout bench and handles-foot/leg attachments with adjustable bands removeably positioned therebetween and methods of use thereof may include the ability to provide exercises with resistance bands which engage muscle exertion through a full range of muscle motion versus hand, bar, or dumbbells.

Another feature of the workout bench and handles-foot/leg attachments with adjustable bands removeably positioned therebetween and methods of use thereof may include its ability to reduce the cost of a total exercise gym by reducing the number of components.

Another feature of the workout bench and handles-foot/leg attachments with adjustable bands removeably positioned therebetween and methods of use thereof may include its ability to reduce the shipping weight and therefore cost of a total exercise gym.

Another feature of the workout bench and handles-foot/leg attachments with adjustable bands removeably positioned therebetween and methods of use thereof may include its ability to enable a user to adjust the resistance bands by adding or removing bands or by changing to different resistance bands to achieve a user's desired resistance.

Another feature of the workout bench and handles-foot/leg attachments with adjustable bands removeably positioned therebetween and methods of use thereof may include its ability to provide a full-sized workout bench that's specially designed with band mounts to incorporate adjustable resistance bands when exercising.

Another feature of the workout bench and handles-foot/leg attachments with adjustable bands removeably positioned therebetween and methods of use thereof may include its ability to provide a specially designed seated row attachment that incorporates the adjustable resistance bands used for seated row exercises.

Another feature of the workout bench and handles-foot/leg attachments with adjustable bands removeably positioned therebetween and methods of use thereof may include its ability to provide an adjustable resistance bands that can be detached from the bench/apparatus and used as a stand-alone device for adding additional resistance band exercises.

Another feature of the workout bench and handles-foot/leg attachments with adjustable bands removeably positioned therebetween and methods of use thereof may include its ability to provide one or more (3) band workout apparatus with handles & leg attachments with a locking features for each band to be used with the adjustable resistance bands for workouts.

These and other features of the workout bench and handles-foot/leg attachments with adjustable bands removeably positioned therebetween and methods of use will become more apparent to one skilled in the art from the prior Summary and following Brief Description of the Drawings, Detailed Description of exemplary embodiments thereof, and Claims when read in light of the accompanying Drawings or Figures.

BRIEF DESCRIPTION OF THE DRAWINGS

The present workout bench and handles-foot/leg attachments with adjustable bands removeably positioned therebetween and methods of use will be better understood by reading the Detailed Description of the Preferred and Selected Alternate Embodiments with reference to the accompanying drawing Figures, in which like reference numerals denote similar structure and refer to like elements throughout, and in which:

FIGS. 3B1 and 3B2 are a side views of an exemplary embodiment of the vertical frame band mount, according to FIG. 3A;

FIGS. 4C1 and 4C2 are side views of an exemplary embodiment of the horizontal frame band mount, according to FIG. 4A;

FIG. 7.1 is an front perspective view of an exemplary embodiment of the workout bench system in use, shown a user performing an incline press exercise;

FIG. 7.2 is an front perspective view of an exemplary embodiment of the workout bench system in use, shown a user performing a bent over rows exercise;

FIG. 7.3 is an front perspective view of an exemplary embodiment of the workout bench system in use, shown a user performing a bench press exercise;

FIG. 7.4 is an front perspective view of an exemplary embodiment of the workout bench system in use, shown a user performing a seated rows exercise;

FIG. 7.5 is an front perspective view of an exemplary embodiment of the workout bench system in use, shown a user performing a military press exercise;

FIG. 7.6 is an front perspective view of an exemplary embodiment of the workout system in use, shown a user performing a military press exercise with handles and foot straps;

FIG. 7.7 is an front perspective view of an exemplary embodiment of the workout system in use, shown a user performing a squats exercise with handles and foot straps; and FIG. 7.8 is an front perspective view of an exemplary embodiment of the workout system in use, shown a user performing a curls exercise with handles and foot straps.

Figure 1C:
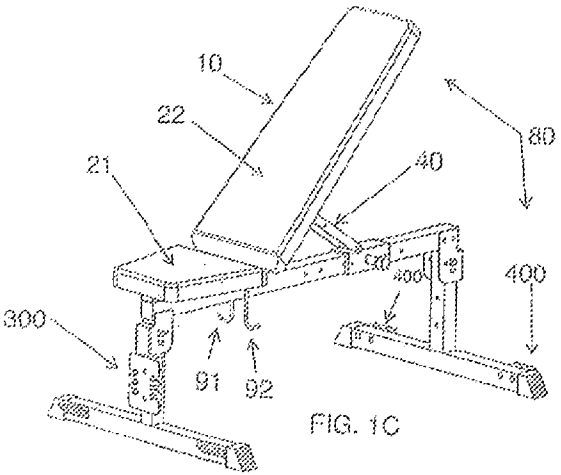
FIG. 1C is a perspective view of the workout bench according to select embodiments of the instant disclosure, shown as an adjustable incline bench.
Figure 1D:
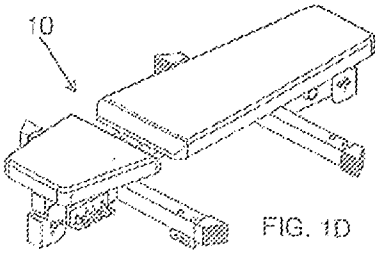
FIG. 1D is a perspective view of the workout bench according to select embodiments of the instant disclosure, shown as an collapsible and storable bench.
Figure 1B:
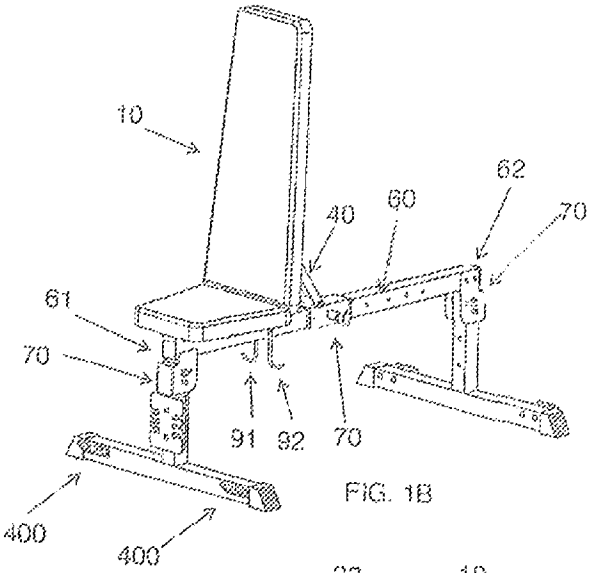
FIG. 1B is a perspective view of the workout bench according to select embodiments of the instant disclosure, shown as an adjustable upright bench.
Figure 1A:
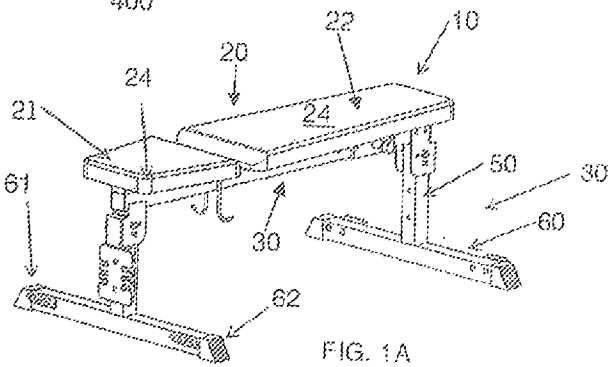
FIG. 1A is a perspective view of the workout bench according to select embodiments of the instant disclosure, shown as a flat bench.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

In describing the exemplary embodiments of the present disclosure, as illustrated in FIGS. 1A, 1B, 1C, 1D, 2A, 2B, 3A, 3B, 3C, 3D, 3E, 4A, 4B, 4C1, 4C2, 4D, 4E, 5A, 5B, 5C, 5D, 6A, 6B, 6C, 7.1, 7.2, 7.3, 7.4, 7.5, 7.6, 7.7, and 7.8 specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Referring now to FIGS. 1A, 1B, 1C, and 1D by way of example, and not limitation, there is illustrated an example embodiment of a bench or adjustable bench, such as workout bench 10. Workout bench 10 may be for providing a flat bench, a varying degree of adjustment vertically adjustable incline bench, a seated upright back support bench to support user U while performing an exercise E, such as strength training or stretching, and/or a collapsible bench for ease of storage and shipping. Workout bench 10 may generally include platform 20 and support structure, such as support frame 30 configured to support platform 20. Platform 20 may include padding 22 and covering 24, such as faux leather and may be for providing a comfortable cushion for user U to sit or lay thereon. Moreover, platform 20 may include a seat 21 and a backrest 22. Support frame 30 may include one or more support members 40 configured to hingedly elevate, support, and stabilize platform 20. Support frame 30 may include at least one vertical support member 50 (first vertical support member and second vertical support member) preferably configured to raise or elevate platform 20 above the floor and each at least one vertical support member 50 may include at least one horizontal foot member 60 preferably configured integral, removable, affixed, or pivotable thereto vertical support member 50 and to further be in contact with the floor, provide a broad and stable base, and may be configured to provide horizontal support for at least one vertical support member 50. Each at least one horizontal member 60 may further include first foot member end 61 and second foot member end 62 for providing broadened base to stabilize workout bench 10. Moreover, at least one horizontal member 60 may be configured to provide horizontal support between two of at least one vertical support member 50. Preferably, at least one horizontal member 60 may include one or more hangers, such as first hanger 91 and second hanger 92.

It is further contemplated herein that one or more support members 40 or vertical support member 50 or horizontal member 60 of support frame 30 may be configured with adjustable mechanism 70 to preferably enable one or more support members 40 or vertical support member 50 or horizontal member 60 to pivot, collapse, latch, unlatch, or adjust one or more support members 40 to, for example, enable a collapsible workout bench 10 via pivot therebetween vertical support member 50 and horizontal member 60 for storage of workout bench 10. Moreover, adjustable mechanism 70 may enable hinged adjustment of backrest 22 to a variety of inclined angles 80 or hingedly elevate.

Figure 2B:
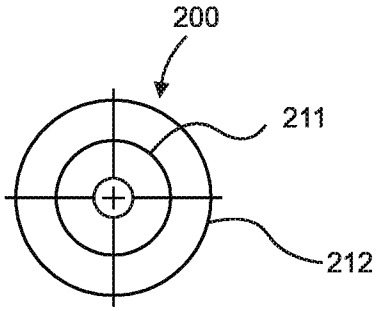
FIG. 2B is a distal end view of the resistance band, according to FIG. 2A.
Figure 2A:
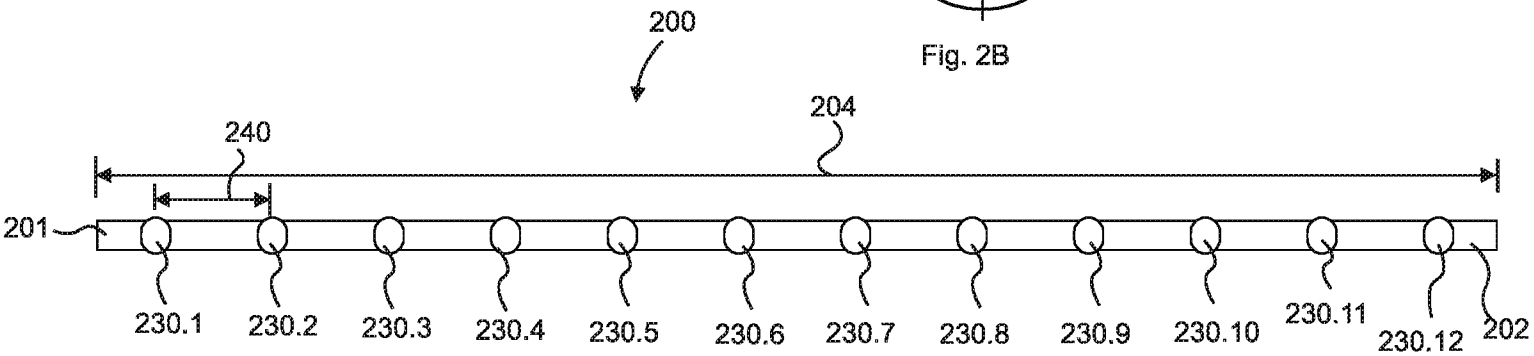
FIG. 2A is a side view of the resistance band according to select embodiments of the instant disclosure.
Figures 3A, 3C, 3D, 3E:
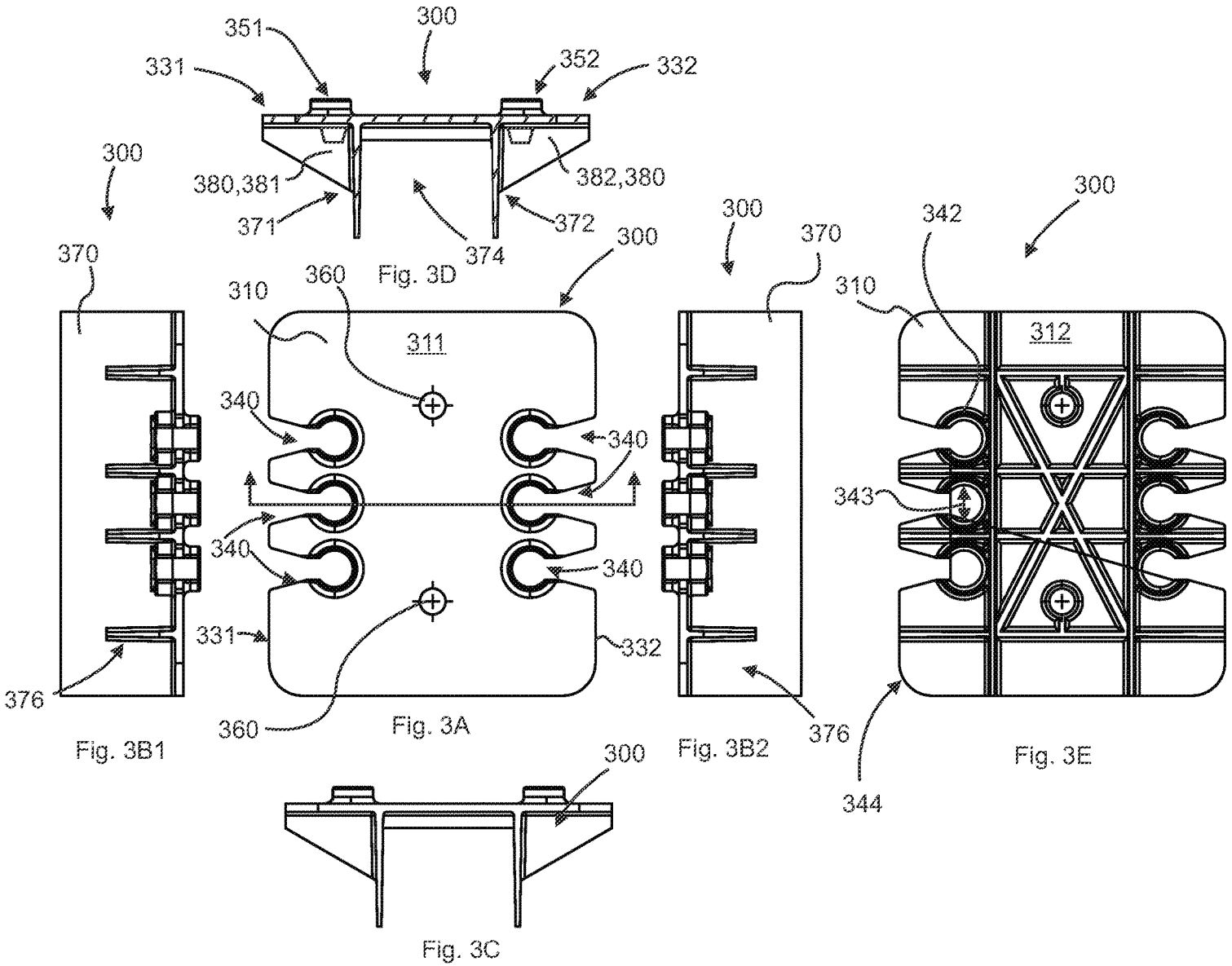
FIG. 3A is a top view of an exemplary embodiment the vertical frame band configured to affix thereto at least one vertical support member of the workout bench, according to FIG. 1.
FIG. 3C is an end view of an exemplary embodiment of the vertical frame band mount, according to FIG. 3A.
FIG. 3D is an cross-section end view of an exemplary embodiment of the vertical frame band mount, according to FIG. 3A.
FIG. 3E is a back view of an exemplary embodiment of the vertical frame band mount, according to FIG. 3A.
Figures 4A, 4B, 4D, 4E:
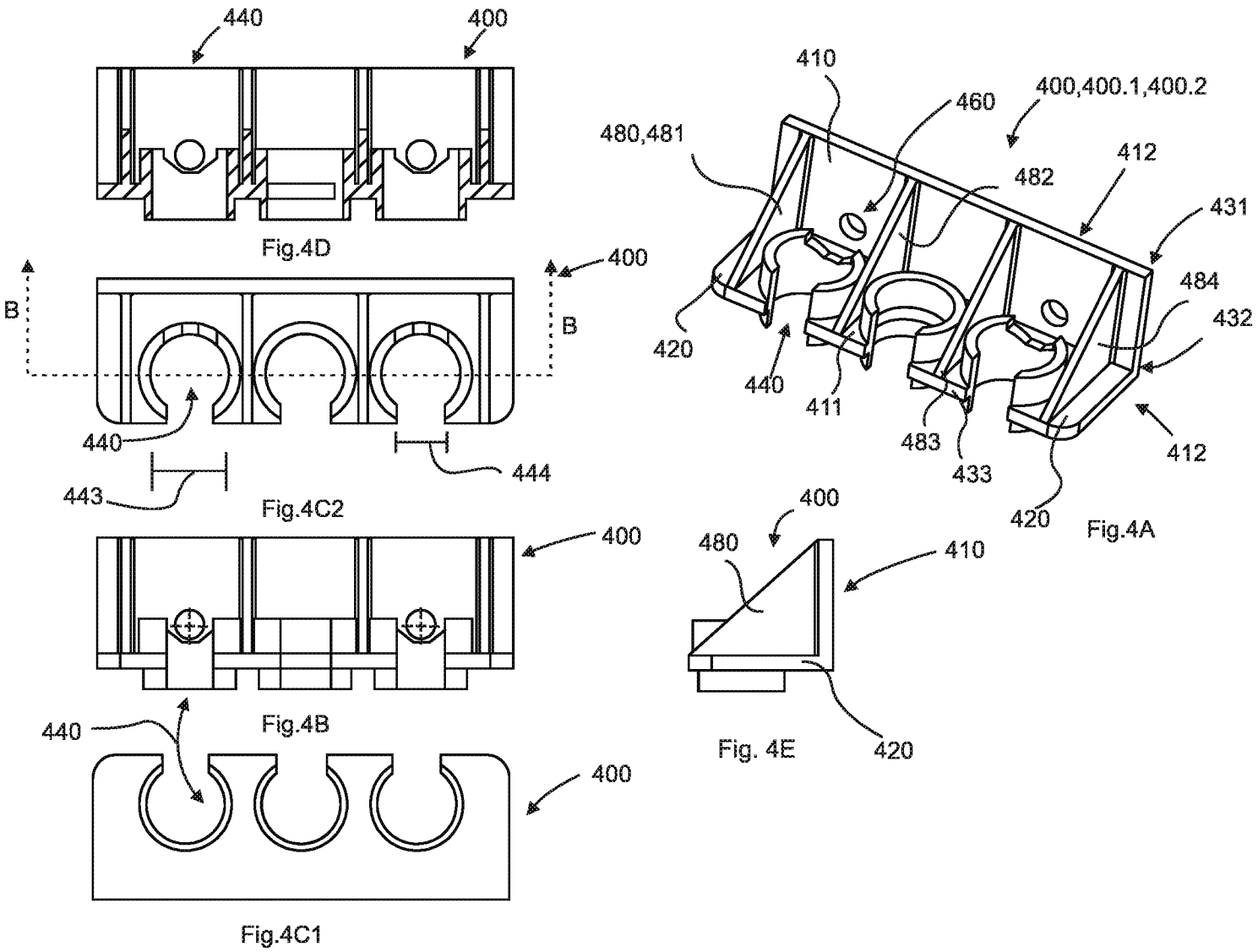
FIG. 4A is a perspective view of an exemplary embodiment of the horizontal frame band mount configured to affix thereto at least one vertical support member of the workout bench, according to FIG. 1
FIG. 4B is a top view of an exemplary embodiment of the horizontal frame band mount, according to FIG. 4A.
FIG. 4D is an cross-section end view of an exemplary embodiment of the horizontal frame band mount, according to FIG. 4A.
FIG. 4E is an end view of an exemplary embodiment of the horizontal frame band mount, according to FIG. 4A.
Figures 5A, 5B, 5C, 5D:
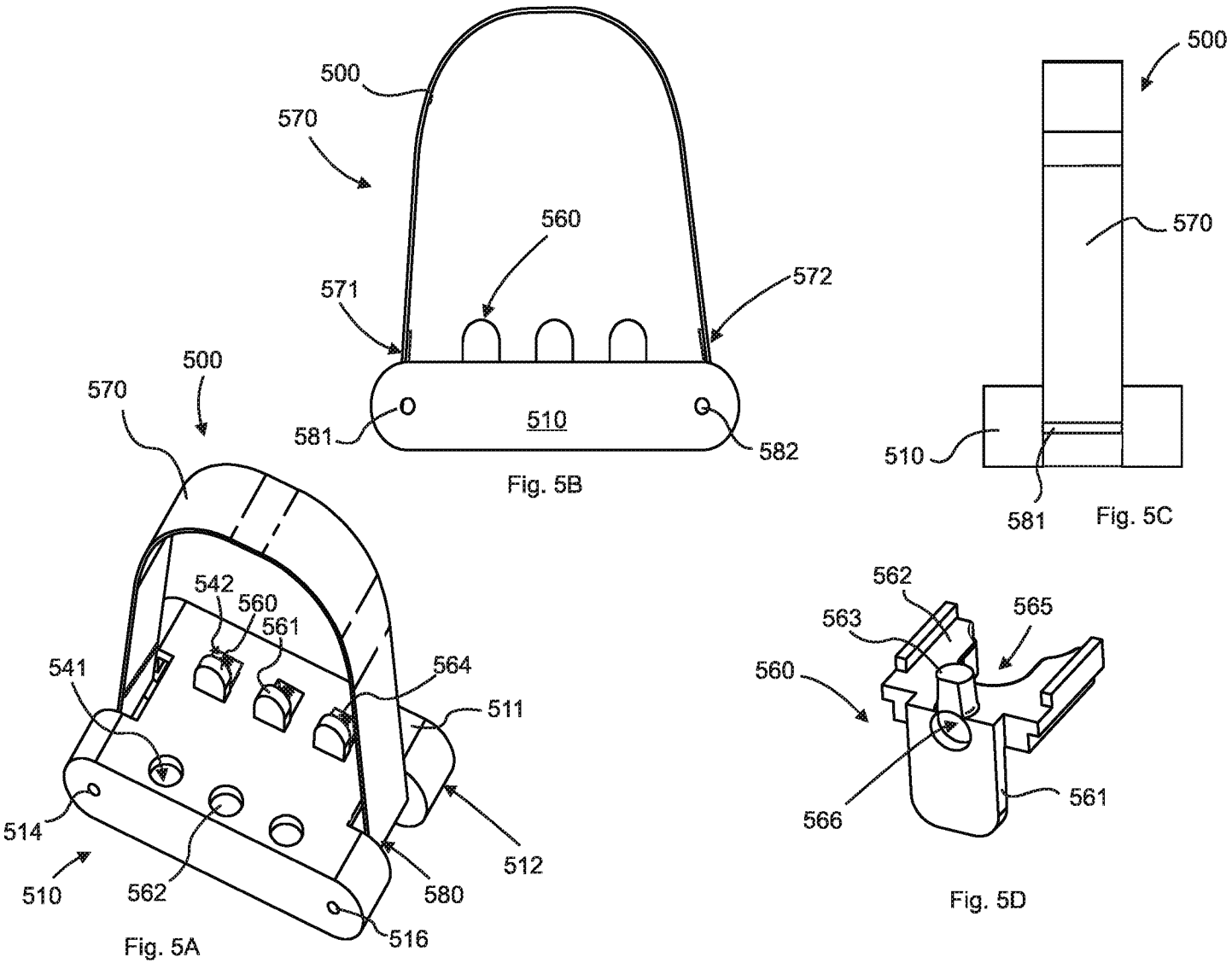
FIG. 5A is a perspective view of an exemplary embodiment of a foot band grip configured to affix thereto one end of the resistance band, according to FIG. 2.
FIG. 5B is a side view of an exemplary embodiment of the foot band grip, according to FIG. 5A.
FIG. 5C is an end view of an exemplary embodiment of the foot band grip, according to FIG. 5A.
FIG. 5D is a perspective view of an exemplary embodiment of the band grip device for the foot band grip, according to FIG. 5A and 5B.

Referring now to FIGS. 2A and 2B, by way of example, and not limitation, there is illustrated an example embodiment of a resistance exercise device, band, or tube, such as resistance band 200. Resistance band 200 may include first band end 201 and second band end 202 and preferably resistance band 200 may extend a linear length 204 therebetween first band end 201 and second band end 202. Resistance band 200 may include a general first cross section or width, such as first band diameter 211. Moreover, resistance band 200 may include a plurality of raised portions, such as raised stops 230 (230.1 through 230.12) linearly positioned or formed thereon resistance band 200 and preferably spaced apart a distance 240 therebetween first band end 201 and second band end 202. Raised stops 230 may include a general second cross section, shown as second band diameter 212 wherein second diameter 212 may be greater or larger in diameter than first diameter 211. It is contemplated herein that raised stops 230 thereon resistance band 200 may be utilized to adjustably catch in a slotted aperture to enable length adjustment of resistance band 200.

Referring now to FIGS. 3A, 3B1, 3B2, 3C, 3D, and 3E, by way of example, and not limitation, there is illustrated an example embodiment of a workout bench band mount or front band mount, such as vertical frame band mount 300. Vertical frame band mount 300 may be for providing a one piece mount to friction fit, latch, attach or removeably affix thereto support frame 30 and more specifically thereto vertical support member 50. Vertical frame band mount 300 may further include plate with front surface 311 and back surface 312, such as planar member 310 having two or more edges, such as first plate edge 331 and second plate edge 332. Planar member 310 may include a plurality of spaced slotted holes, such as slotted apertures 340 configured therethrough planar member 310. Slotted apertures 340 may be for receiving first band end 201 of resistance band 200 and preferably designed to receive first band diameter 211 of resistance band 200 therethrough slotted apertures 340 preferably sized having a general width, such as slot opening 344 and catch one of raised stops 230 therein slotted apertures 340 preferably sized having a general width or diameter, such as slot aperture 343 to releasably affix first band end 201 of resistance band 200 thereto vertical frame band mount 300 to enable length adjustment of resistance band 200. It is contemplated herein that slot aperture 343 may preferably be sized therebetween first band diameter 211 and second band diameter 212. Slotted apertures 340 may be preferably sized to receive resistance band 200 general first cross section, shown as first diameter 211 therein but catch or prevent raised stops 230 from sliding or fitting therethrough. Slotted apertures 340 may further include two or more sets of slotted apertures 340 including first set of slotted apertures 351 preferably positioned proximate first plate edge 331 and second set of slotted apertures 352 positioned proximate second plate edge 332. First set of slotted apertures 351 may be for receiving first band end 201 of first resistance band 200.1 and preferably designed to catch one of raised stops 230 to releasably affix first band end 201 of first resistance band 200.1 thereto first set of slotted apertures 351 preferably positioned proximate first plate edge 331 of vertical frame band mount 300. Second set of slotted apertures 352 may be for receiving first band end 201 of second resistance band 200.2 and preferably designed to catch one of raised stops 230 to releasably affix first band end 201 of second resistance band 200.2 thereto second set of slotted apertures 352 preferably positioned proximate second plate edge 332 of vertical frame band mount 300 (as shown in FIG. 7.6).

Planar member 310 may further include one or more holes, such as connector apertures 360. Connector apertures 360 may be for receiving a bolt or screw, such as attachment device to releasably affix or connect vertical frame band mount 300 to support frame 30 and more specifically thereto vertical support member 50.

Vertical frame band mount 300 may further include at least two spaced apart tabs, flaps, or flanges, such as extension members 370. Extension members 370, such as first extension member 371 and second extension member 372, which may be designed for creating an open ended channel 374 to receive vertical support member 50 to releasably affix vertical frame band mount 300 to support frame 30. Extension members 370 may be configured as spaced apart extension members 370 extending therefrom back surface 312 of planar member 310 preferably in a spaced apart and configured approximately perpendicular thereto back surface 312 to form open ended channel 374. Open ended channel 374 may further include one or more clips 376. One or more clips 376 may be utilized to grip or clasp to vertical support member 50 to releasably affix vertical frame band mount 300 to support frame 30. Extension members 370 may further include stabilizer supports 380, such as first stabilizer support 381 and second stabilizer support 382. Stabilizer supports 380 may be configured between extension members 370 and back surface 312 and may be configured to approximately maintain extension members 370 perpendicular thereto back surface 312.

Referring now to FIGS. 4A, 4B, 4C1, 4C2, 4D, and 4E, by way of example, and not limitation, there is illustrated an example embodiment of a workout bench band mount or foot band mount, such as horizontal frame band mount 400. Horizontal frame band mount 400 may be for providing a one piece mount to friction fit, latch, attach or removeably affix thereto support frame 30 and thereto horizontal support member, such as horizontal foot member 60 and more specifically thereto first foot member end 61 and second foot member end 62. Horizontal frame band mount 400 may further include an angled member with a first planar member 410 and second planar member 420. First planar member 410 may include front surface 411 and back surface 412, such as first planar member 410 having two or more edges, such as first plate edge 431 and second plate edge 432. Second planar member 420 may include front surface 411 and back surface 412, such as second planar member 420 having two or more edges, such as first plate edge 433 and second plate edge 432. It is contemplated herein that first planar member 410 and second planar member 420 may be attached or integral thereto one another and may be formed at approximately ninety degrees or perpendicular to one another and attached at second plate edge 432. Second planar member 420 may include a plurality of spaced slotted holes, such as slotted apertures 440 configured therethrough planar member 410. Slotted apertures 440 may be for receiving first band end 201 of resistance band 200 and preferably designed to receive first band diameter 211 of resistance band 200 therethrough slotted apertures 440 preferably sized having a general width, such as slot opening 444 and catch one of raised stops 230 therein slotted apertures 440 preferably sized having a general width or diameter, such as slot aperture 443 to releasably affix first band end 201 of resistance band 200 thereto horizontal frame band mount 400 to enable length adjustment of resistance band 200. It is contemplated herein that slot aperture 443 may preferably be sized therebetween first band diameter 211 and second band diameter 212. Slotted apertures 440 may be preferably sized to receive resistance band 200 general first cross section, shown as first diameter 211 therein but catch or prevent raised stops 230 from sliding or fitting therethrough.

First planar member 410 may further include one or more holes, such as connector aperture 460. Connector aperture 460 may be for receiving a bolt or screw, such as attachment device to releasably affix first horizontal frame band mount 400.1 to support frame 30 and more specifically thereto first foot member end 61 and second horizontal frame band mount 400.2 thereto second foot member end 62.

Horizontal frame band mount 400 may further include one or more stabilizer supports 480, such as first stabilizer support 481, second stabilizer support 482, third stabilizer support 483, and fourth stabilizer support 484. Stabilizer supports 480 may be configured between first planar member 410 and second planar member 420 and may be configured to maintain or hold first planar member 410 and second planar member 420 approximately perpendicular thereto one another.

Referring now to FIGS. 5A, 5B, 5C, and 5D, by way of example, and not limitation, there is illustrated an example embodiment of a limb band device for ankle A, shin S, leg L, forearm F, such as foot band mount 500. Foot band mount 500 may be for providing a one piece mount to attach or removeably affix thereto a user's U ankle A, shin S, leg L, forearm F and more specifically thereto user's foot F. Foot band mount 500 may further include plate with front surface 511 and back surface 512, such as foot planar member 510. Foot planar member 510 may include a plurality of spaced holes, such as band apertures 541 and correlating spaced and internally connected latch slot 542 configured therethrough foot planar member 510 between opposite ends, such as first planar end 514 and second planar end 516. Band apertures 541 may be for receiving second band end 202 of resistance band 200 and preferably designed to receive first band diameter 211 of resistance band 200 therethrough band apertures 541 preferably sized having a general width to accommodate first band diameter 211. Latch slot 542 may be configured having a band latch to hold resistance band 200 therein, such as band grip device 560. Band grip device 560 may include lever 561 and a forked, u-shaped, or ram, such as band grip 562 to receive resistance band 200 therein band slot 565, integrally connected thereto lever 561, and having guide pin 563. Band grip device 560 may be for providing a one piece linear travelling resistance band 200 gripping device to grip or secure first band end 201 of resistance band 200 therein band apertures 541. Moreover, band grip device 560 may be biased between an open position wherein second band end 202 of resistance band 200 may be inserted therein band apertures 541 and closed or gripping position wherein second band end 202 of resistance band 200 may be gripped or in a removeably affixed position therein band apertures 541. It is contemplated herein that band grip device 560 may be biased between an open position and a gripped or in a removeably affixed position via spring 564 held therein spring slot 566. It is further contemplated herein that lever 561 may be positioned, moved, or operated by user U between an open position and a gripped or in a removeably affixed position via by pushing against spring 564.

Foot band mount 500 may further include a strap or band, such as foot strap 570 having a first strap end 571 and a second strap end 572, which may be provided for attaching or removeably affixing user's U ankle A, shin S, leg L, forearm F and more specifically thereto user's foot F thereto foot band mount 500. First strap end 571 may be configured to attach or removeably affix thereto first planar end 514 and a second strap end 572 may be configured to attach or removeably affix thereto second planar end 516 of foot planar member 510. It is contemplated herein that foot strap 570 may include an adjustment mechanism (buckle, hook and loop, D-rings or the like) to adjust the length of foot strap 570 between first strap end 571 and second strap end 572 to accommodate or cinch thereto user's U ankle A, shin S, leg L, forearm F and more specifically thereto user's foot F. It is further contemplated herein that first strap end 571 and second strap end 572 may be positioned therein notch 580 and removeably attached thereto first planar end 514 and second planar end 516, respectively via pin 581 inserted therein pin hole 582 or other like strap attachment methods.

It is contemplated herein that foot band mount 500 and more specifically front surface 511 and back surface 512, first planar end 514 and second planar end 516, may be configured or formed with curved surfaces or ends to accommodate, fit, or contour thereto user's U ankle A, shin S, leg L, forearm F and more specifically thereto user's foot F and may also be configured or formed with curved ends or corners to remove sharp edges and corners for comfort and safety or may be configured from two or more pieces and assembled therefrom.

Figures 6A, 6B, 6C:
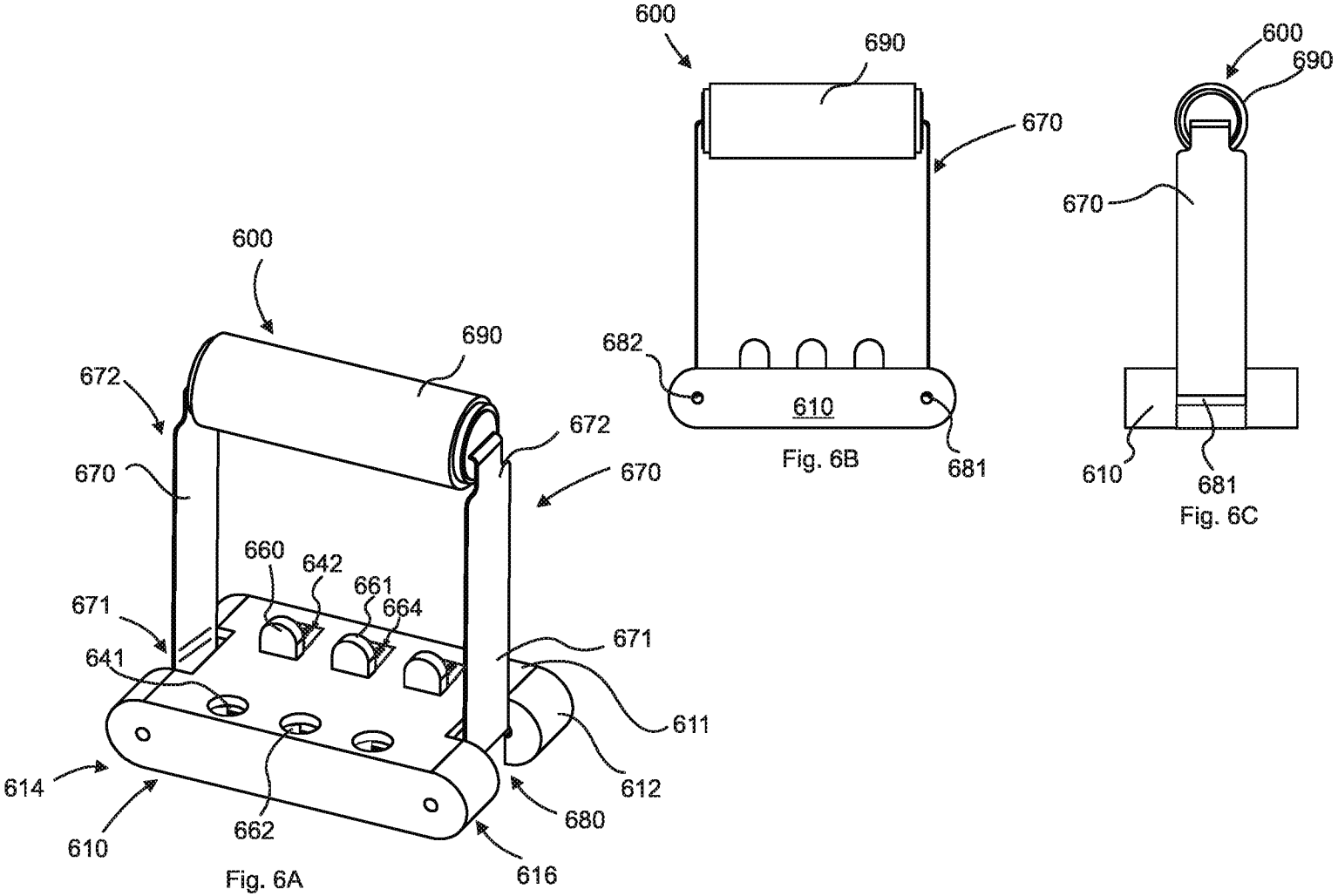
FIG. 6A is a perspective view of an exemplary embodiment of a hand grip configured to affix thereto one end of the resistance band, according to FIG. 2.
FIG. 6B is a side view of an exemplary embodiment of the hand grip, according to FIG. 6A.
FIG. 6C is an end view of an exemplary embodiment of the hand grip, according to FIG. 6A.

Referring now to FIGS. 6A, 6B, and 6C, by way of example, and not limitation, there is illustrated an example embodiment of a limb band device, such as handle band mount 600. Handle band mount 600 may be for providing a one piece mount to be gripped by a user's U hand H. Handle band mount 600 may further include plate with front surface 611 and back surface 612, such as handle planar member 610. Handle planar member 610 may include a plurality of spaced holes, such as band apertures 641 and correlating spaced and internally connected latch slot 642 configured therethrough handle planar member 610 between first planar end 614 and second planar end 616. Band apertures 641 may be for receiving second band end 202 of resistance band 200 and preferably designed to receive first band diameter 211 of resistance band 200 therethrough band apertures 641 preferably sized having a general width to accommodate first band diameter 211. Latch slot 642 may be configured having a band latch to hold resistance band 200 therein, such as band grip device 660. Band grip device 660 may include lever 661 and a forked, u-shaped, or ram, such as band grip 662 integrally connected thereto lever 661. Band grip device 660 may be for providing a one piece linear travelling resistance band 200 gripping device to grip second band end 202 of resistance band 200 therein band apertures 641. Moreover, band grip device 660 may be biased by a spring, such as bias element 664 between an open position wherein second band end 202 of resistance band 200 may be inserted therein band apertures 641 and gripping position wherein second band end 202 of resistance band 200 may be gripped or in a removeably affixed position therein band apertures 641. It is contemplated herein that band grip device 660 may be biased between an open position and a gripped or in a removeably affixed position via spring 664 held therein spring slot 566. It is further contemplated herein that lever 661 may be positioned, moved, or operated by user U between an open position and a gripped or in a removeably affixed position via by pushing against spring 664.

Handle band mount 600 may further include two or a pair of straps or bands or rigid extensions, such as spaced handle vertical members 670 having first handle vertical member end 671 and second handle vertical member end 672, which may be provided for attaching or affixing a grip such as handle 690 thereto handle planar member 610. First vertical member end 671 may be configured to attach or removeably affix thereto first planar end 514 of foot planar member 510. It is contemplated herein that vertical members 670 may include an adjustment mechanism (buckle, hook and loop, D-rings or the like) to adjust the length of vertical members 670 between first strap end 571 and second strap end 572 to accommodate hand H. It is further contemplated herein that first vertical member end 671 may be positioned therein notch 680 and removeably attached thereto first planar end 614 via pin 681 inserted therein pin hole 682 or other like strap attachment methods.

It is contemplated herein that handle band mount 600 and more specifically front surface 511 and back surface 512, first planar end 614 and second planar end 616, may be configured or formed with curved ends or corners to remove sharp edges and corners for comfort and safety.

Referring now to FIGS. 7 (7.1, 7.2, 7.3, 7.4, 7.5, 7.6, 7.7, and 7.8) by way of example, and not limitation, there is illustrated an example embodiment of a user U performing a variety of exercises or an individual strength exercise utilizing workout bench 10, resistance band 200, vertical frame band mount 300, horizontal frame band mount 400, foot band mount 500, and handle band mount 600, two or more workout bench system to perform a group of strength exercises.

Referring again to FIG. 7.1 there is illustrated an example embodiment of a user U performing an incline press exercise. Here user U is seated thereon workout bench 10 with workout bench 10 in an inclined position. First band end 201 of a pair of resistance bands 200 may be removeably affixed to horizontal frame band mount 400 mounted thereto back horizontal foot member 60. Second band end 202 of a pair of resistance bands 200 may be removeably affixed to a pair of handle band mounts 600. User U may grip handle band mounts 600 and raise and lower hands H in the resistance exercise motion EM to perform the incline press exercise.

Referring again to FIG. 7.2 there is illustrated an example embodiment of a user U performing a bent over row exercise. Here user U may be positioned adjacent workout bench 10 with one knee K and one hand H on workout bench 10 in a bent over position. First band end 201 of a pair of resistance bands 200 may be removeably affixed to horizontal frame band mount 400 mounted thereto front horizontal foot member 60. Second band end 202 of a pair of resistance bands 200 may be removeably affixed to handle band mount 600. User U may grip handle band mounts 600 and raise and lower opposite hand H/elbow E in the resistance exercise motion EM to perform the bent over row exercise.

Referring again to FIG. 7.3 there is illustrated an example embodiment of a user U performing a flat bench press exercise. Here user U may be laying thereon workout bench 10 with workout bench 10 in a flat or horizontal position. First band end 201 of a pair of resistance bands 200 may be removeably affixed to horizontal frame band mount 400 mounted thereto back horizontal foot member 60. Second band end 202 of a pair of resistance bands 200 may be removeably affixed to a pair of handle band mounts 600. User U may grip handle band mounts 600 and raise and lower hands H in the resistance exercise motion EM to perform the flat bench press exercise.

Referring again to FIG. 7.4 there is illustrated an example embodiment of a user U performing a seated row exercise. Here user U may be positioned adjacent workout bench 10 seated on the floor in front of vertical frame band mount 300 with feet contacting horizontal foot member 60. First band end 201 of a pair of resistance bands 200 may be removeably affixed to vertical frame band mount 300 mounted thereto front vertical support member 50. Second band end 202 of a pair of resistance bands 200 may be removeably affixed to handle band mount 600. User U may grip handle band mounts 600 and pull and release hand H/elbow E in the resistance exercise motion EM to perform the seated row exercise.

Referring again to FIG. 7.5 there is illustrated an example embodiment of a user U performing a military press exercise. Here user U may be seated thereon workout bench 10 with workout bench 10 in an upright position. First band end 201 of a pair of resistance bands 200 may be removeably affixed to horizontal frame band mount 400 mounted thereto front horizontal foot member 60. Second band end 202 of a pair of resistance bands 200 may be removeably affixed to a pair of handle band mounts 600. User U may grip handle band mounts 600 and raise and lower hands H in the resistance exercise motion EM to perform the military press exercise.

Referring again to FIG. 7.6 there is illustrated an example embodiment of a user U performing an alternative military press exercise. Here user U may be standing adjacent workout bench. First band end 201 of a pair of resistance bands 200 may be removeably affixed to foot band mount 500. Second band end 202 of a pair of resistance bands 200 may be removeably affixed to a pair of handle band mounts 600. User U may insert feet F into foot band mounts 500, grip handle band mounts 600, and raise and lower hands H in the resistance exercise motion EM to perform the alternative military press exercise. Moreover, first band end 201 of a pair of resistance bands 200 may be removeably affixed to vertical frame band mount 300 mounted thereto front vertical support member 50 and second band end 202 of resistance bands 200 may be removeably affixed to foot band mount 500. User U may insert feet F into foot band mounts 500 and extend feet while sitting on workout bench 10 to perform seated leg extensions.

Referring again to FIG. 7.7 there is illustrated an example embodiment of a user U performing a leg extension or squat exercise. Here user U may be standing adjacent workout bench. First band end 201 of a pair of resistance bands 200 may be removeably affixed to foot band mount 500. Second band end 202 of a pair of resistance bands 200 may be removeably affixed to a pair of handle band mounts 600. User U may insert feet F into foot band mounts 500, grip handle band mounts 600, and raise and lower or bend legs L in the resistance exercise motion EM to perform the alternative squat exercise.

Referring again to FIG. 7.8 there is illustrated an example embodiment of a user U performing a bicep curl exercise. Here user U may be standing adjacent workout bench. First band end 201 of a pair of resistance bands 200 may be removeably affixed to foot band mount 500. Second band end 202 of a pair of resistance bands 200 may be removeably affixed to a pair of handle band mounts 600. User U may insert feet F into foot band mounts 500, grip handle band mounts 600, and raise and lower or curl hands H in the resistance exercise motion EM to perform the bicep curl exercise.

In the specification and/or figures, typical embodiments of the disclosure have been disclosed. The present disclosure is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Moreover, the present disclosure has been described in detail, it should be understood that various changes, substitutions and alterations can be made thereto without departing from the spirit and scope of the disclosure as defined by the appended claims. Accordingly, the present disclosure is not limited to the specific embodiments illustrated herein but is limited only by the following claims.

The invention claimed is:

1. A system for performing a strength exercise, said system comprising:

a bench, said bench having a platform and a support structure to support said bench, said support structure having at least one vertical support member configured to elevate said platform, said vertical support member affixed thereto at least one horizontal support member configured to stabilize said platform;

one or more band mounts configured to affix to said support structure, each band mount having a plurality of slotted apertures;

one or more resistance bands each having a first band end and second band end, said one or more resistance bands having spaced thereon a plurality of raised stops between said first band end and said second band end to adjustably catch one of said raised stops proximate said first band end therein one of said plurality of slotted apertures; and at least one limb band device, said at least one limb band device having a plurality of apertures to receive said second end of said one or more resistance bands.

2. The system of claim 1, wherein said platform includes a seat and a backrest, said backrest configured to hingedly elevate.

3. The system of claim 1, wherein said at least one horizontal member configured to provide horizontal support for two of said at least one vertical support member.

4. The system of claim 3, wherein said at least one horizontal member includes one or more hangers to support said resistance band.

5. The system of claim 3, further includes an adjustable mechanism positioned between said at least one horizontal member and said at least one vertical support member to enable pivot of said at least one vertical support member.

6. The system of claim 1, wherein said plurality of raised stops is configured to adjustably catch in one of said plurality of slotted apertures to enable length adjustment of one or more resistance bands.

7. The system of claim 6, wherein said one or more band mounts further includes a vertical frame band mount configured to attach thereto said at least one vertical support member.

8. The system of claim 7, wherein said vertical frame band mount includes a planar member having a first plate edge and a second plate edge.

9. The system of claim 8, wherein each of said first plate edge and said second plate edge includes said plurality of slotted apertures to adjustably catch one of said raised stops proximate said first band end therein one of said plurality of slotted apertures.

10. The system of claim 9, wherein said at least one limb band device each includes a handle to enable gripping of said at least one limb band device attached to said second band end.

11. The system of claim 10, configured to enable a user to perform a seated row exercise.

12. The system of claim 10, wherein said planar member further includes at least two spaced apart tabs positioned approximately perpendicular to said planar member and configured having an open ended channel to receive said at least one vertical support member.

13. The system of claim 6, wherein said one or more band mounts further includes at least one horizontal frame band mount configured to attach thereto said at least one horizontal support member.

14. The system of claim 13, wherein said at least one horizontal frame band mount each includes a first planar member positioned approximately perpendicular to a second planar member.

15. The system of claim 14, wherein said first planar member configured to attach thereto said at least one horizontal support member.

16. The system of claim 15, wherein said second planar member includes said plurality of slotted apertures to adjustably catch one of said raised stops proximate said first band end therein one of said plurality of slotted apertures.

17. The system of claim 16, wherein said at least one limb band device each includes a handle to enable gripping of said at least one limb band device attached to said second band end.

18. The system of claim 17, configured to enable a user to perform an exercise selected from the group consisting of a row exercise, an incline press, a bench press, or a military press.

19. The system of claim 15, wherein said first planar member further includes a connector aperture to connect said first planar member to said at least one horizontal support member.

* * * * *